US007316183B2

(12) United States Patent
Lorig et al.

(10) Patent No.: US 7,316,183 B2
(45) Date of Patent: Jan. 8, 2008

(54) SLEEVE WITH MULTIPLE LAYER STRUCTURE FOR PRINTING PRESSES AND METHOD FOR ITS MANUFACTURE

(75) Inventors: Heinz W. Lorig, Legden (DE); Stephan Lorig, Legden (DE)

(73) Assignee: Polywest Kunststofftechnik Saueressig & Partner GmbH & Co. KG, Ahaus (DE)

( * ) Notice: Subject to any disclaimer, the term of this patent is extended or adjusted under 35 U.S.C. 154(b) by 279 days.

(21) Appl. No.: 10/525,683

(22) PCT Filed: Jul. 23, 2003

(86) PCT No.: PCT/EP03/08041

§ 371 (c)(1),
(2), (4) Date: Feb. 22, 2005

(87) PCT Pub. No.: WO2004/022340

PCT Pub. Date: Mar. 18, 2004

(65) Prior Publication Data

US 2005/0235849 A1 Oct. 27, 2005

(30) Foreign Application Priority Data

Sep. 6, 2002 (DE) ..... 102 41 800

(51) Int. Cl.
*B41F 13/10* (2006.01)

(52) U.S. Cl. ..... 101/376; 101/382.1

(58) Field of Classification Search ..... 101/216, 101/217, 375, 376, 382.1, 383
See application file for complete search history.

(56) References Cited

U.S. PATENT DOCUMENTS 6,148,725 A * 11/2000 Knauer et al. ..... 101/217
6,371,023 B1 * 4/2002 Francille ..... 101/375
6,484,632 B2 * 11/2002 Hoffmann et al. ..... 101/217
6,640,711 B2 * 11/2003 Smoot et al. ..... 101/375
6,745,692 B2 6/2004 Lorig et al.

FOREIGN PATENT DOCUMENTS

| | | |
|---|---|---|
| DE | 196 12 927 A1 | 11/1996 |
| DE | 195 45 597 A | 6/1997 |
| DE | 196 25 749 C2 | 1/1998 |
| EP | 196 443 B1 | 5/1990 |
| EP | 0 753 416 A1 | 7/1995 |
| FR | 2 811 256 A | 1/2002 |

* cited by examiner

*Primary Examiner*—Ren Yan
(74) *Attorney, Agent, or Firm*—Fay Sharpe LLP

(57) ABSTRACT

The invention concerns a sleeve with a multiple layer structure for printing presses with king rolls configured as pneumatic cylinders; in particular a sleeve for the flexographic printing process, with an inner tube of reversibly expandable plastic material, whose internal diameter is smaller than the king roll diameter, with an elastic compressible intermediate layer that accommodates the radial expansion of the inner tube during installation, and with an outer layer. The invention concerns also a manufacture procedure for sleeves of this type. The sleeve in accordance with the invention is characterised by a support structure in the sleeve construction between inner tube and outer layer, which completely penetrates the compressible intermediate layer in at least one location in the radial direction and stabilises the outer layer relative to the inner tube in the circumferential direction and/or the radial direction. As a result of the partial bridging of the compressible intermediate layer this is offloaded from forces in the direction of rotation. In this manner the possibility that vibration stripes can appear in the print image is avoided.

20 Claims, 2 Drawing Sheets

SLEEVE WITH MULTIPLE LAYER STRUCTURE FOR PRINTING PRESSES AND METHOD FOR ITS MANUFACTURE

BACKGROUND OF THE INVENTION

The invention relates to a sleeve with a multiple layer structure for printing presses with king rolls designed as air cylinders, in particular to a sleeve for the flexographic printing process, with an inner tube of reversibly expandable plastic material, whose internal diameter is smaller than the king roll diameter, with an elastic compressible intermediate layer accomodating the radial expansion of the inner tube during mounting or dismounting of the sleeve, and with an outer layer. The invention relates also to a method for manufacturing sleeves of this type with the steps of manufacture of a reversibly expandable inner tube, applying compressible intermediate layer on the outer surface of the inner tube and applying a single or multiple ply transition layer of a low density material that can be cast or foamed, and/or applying of an outer layer.

In the printing industry, in particular in the flexographic printing process, the state of the art technology has for years included working with sleeves, which carry the printing layer, the printing block or plate for the later printing process, and which can be pushed on to the significantly more expensive king rolls, supported in bearings in the printing presses, and configured as air cylinders, mostly of metal or with a circumferential layer of metal. The installation and de-installation of the sleeve takes place using the air cushion principle, in which compressed air exits via at least one radial hole on the outer surface of the king roll, with which air the inner tube of the sleeve is reversibly expanded during the installation or de-installation, so that it can be pushed axially on to the king roll in its expanded state, or can be pulled off the same, with low expenditure of force. When the compressed air supply is switched off the inner tube of the sleeve contracts again and the sleeve sits on the outer surface of the king roll with a shrink fit, secured against rotation, as is known art from e.g. EP 196 443 B1. The reversible, expandable inner tube consists mostly of a relatively thin-walled plastic tube laminated with fibre inlays, which is directly surrounded by a thicker walled layer of elastic compressible material, in particular such as a soft foam, which makes possible or allows the expansion of the inner tube during installation or de-installation of the sleeve.

Onto the elastic compressible layer can directly be applied an outer layer, which comprises a surface suitable for reception of the printing plates, printing platens or printing layer, or between the soft foam layer and the outer layer is located an incompressible intermediate layer, for example of a cast mass of low density or a rigid foam, as a result of which the diameter of the sleeve in the radial direction can be increased by up to 100 mm, without the weight of the sleeve increasing significantly. The various print patterns can be generated by means of the wall thickness of the sleeves used. However for printing sleeves the variation of wall thickness in the radial direction is limited, since with increasing thickness of the sleeves the deviations in diameter and concentricity increase and an exact print can no longer be guaranteed. For these reasons the printing industry has therefore changed its practice to inserting adapter sleeves between the pneumatic cylinders and the sleeves, which are themselves fitted with a compressible layer and, using the air cushion principle, can be axially pushed on to the pneumatic cylinder. The adapter sleeves in turn are fitted on their outer surface with an air feed for the compressed air, so as then to be able to install the sleeve bearing the print motif or the printing plate onto the pre-assembled unit of pneumatic cylinder and adapter sleeve.

EP 0 753 416 A1 discloses to firstly assemble the adapter sleeve and the sleeve carrying the print motif, and then to install the composite structure of adapter sleeve and print sleeve onto the king roll of the printing press, designed as an air cylinder, using the air cushion principle.

From DE 195 45 597 A1 a sleeve of like type is known art, whose outer layer consists of a metal tube that can directly be engraved. The space between the expandable inner tube and the elastic compressible layer, and also the outer tube, is filled with a foam of PUR, BS, UF, PF, PVC or PE.

When printing with sleeves, which for purposes of installation comprise at least one compressible layer between the inner tube and the outer layer, or are assembled on adapter sleeves, which comprise a corresponding compressible layer, axial lines often appear in the print image, for which up to the present time various causes have been attributed. One cause for these lines, identified by expert groups, as vibration stripes, is seen to be the tapes with which the printing plates are installed on the outer layer of the sleeve, and which should prevent relative movements between the plates and the sleeves. In particular with the use of thick and soft tapes it can be necessary for a good colour transfer to increase the feed pressure between the king roll and the impression cylinder, as a result of which the gears of the king roll and the impression cylinder can engage too fiercely, such that axial gear stripes or chatter marks can appear in the print image. Other causes for axial stripes or vibration lines are seen to be worn-out bearings and the vibrations that are thereby generated, as well as an unfavourable drive layout that generates vibration harmonics during the printing process.

In modern printing presses the running performance of the presses, in particular the rotational speed of the king rolls and the impression cylinders is continuously increasing, and the printing press manufacturers, by means of new types of drives, lighter materials for the king rolls used, and improved bearing arrangements, can increase by any amount rotational speeds that seemingly can be controlled. With increasing rotational speeds of the king rolls and impression cylinders it is seen however that the problem of vibration lines or vibration stripes increases more than proportionally. In particular vibration lines then appear when working with print sleeves or adapter sleeves for large pattern repeat lengths, which comprise compressible layers for installation using the air cushion principle.

SUMMARY OF THE INVENTION

An object of the invention is to provide sleeves for the printing industry that can be installed onto king rolls using the air cushion principle, and that do not generate any vibration lines in the print image, even at high rotational speeds.

The sleeve in accordance with the invention is characterised by a support structure integrated in the sleeve structure between inner layer and outer layer, which completely penetrates the compressible intermediate layer in at least one position in the radial direction and stabilises the outer layer relative to the inner tube in the circumferential direction and/or the radial direction. The invention is based on findings that in the printing process with fast rotating king rolls and printing sleeves the colour particles adhering to the printing plate or to the printing layer, and also the substrates to be printed on, such as paper webs, films, or similar, retard the printing layer relative to the driven king roll. This retarding effect is additionally enhanced by the colour inking system that transfers the colour particles, the surface properties of the substrate, by colour transfer rollers, scrapers and similar. The resistance to rotation of the king roll and therefore the printing plate increases with the square of the increasing rotational speed of the king rolls. The inventors of the present invention have now identified that the compressible layer in the sleeve construction, because of its material properties and because of its comparatively large radial distance from the printing plate, tends can be yield as a result of the resistance forces and the retarding moment introduced by the latter into the sleeve. The yielding results in a displacement in the circumferential direction between the printing plate and the inner tube that is firmly attached to the king roll. The support structure provided in accordance with the invention in the region of the compressible layer prevents this effect and at the same time causes that in the event of a too high feed pressure between printing cylinder and king roll the pattern bridging produced with the incompressible cast mass or the rigid foam does not extend into the compressible layer and cannot generate defects in the print image. As a result of the support structure integrated into the sleeve construction the outer layer is stabilised relative to the inner tube with partial bridging of the compressible intermediate layer in the direction of rotation, so that for a sleeve in accordance with the invention, displacements caused by rotation or torsion in the compressible layer are prevented. Therefore for sleeves in accordance with the invention the problem also does not occur in which a restoring force can be stored in the compressible layer, which in the event of uneven retarding resistances could generate a forwards acceleration of the printing plate in the direction of rotation of the king roll. The fundamental solution provided by the invention therefore consists in the stiffening of the compressible layer at least partially in the direction of rotation and in the radial direction, or, in other words, in removing the forces in the direction of rotation from the compressible layer.

In a configuration in accordance with the invention the support structure can consist of a number of radial struts distributed circumferentially in a symmetrical manner. In the preferred configuration in accordance with the invention, however, the support structure includes rings concentrically surrounding the inner tube, or consists of these. Here the compressible layer can preferably be interrupted either by radial holes or by concentric ring-shaped and preferably turned recesses, where the support structure is arranged in the radial holes or recesses and partially replaces and bridges the compressible layer.

The sleeve in accordance with the invention can, apart from the support structure in accordance with the invention, otherwise have a structure that in the current status of technology is basically of known art. In particular between the outer layer and the compressible intermediate layer can be arranged a single or multiple ply transition layer from a plastic material of low density, or the outer layer itself consists of a plastic material of low density. In a preferred configuration in accordance with the invention the transition layer and/or the outer layer consist of a material that can be cast or foamed, such as is of known art to the applicant, for example from DE 196 25 749 C2 or DE 196 12 927 A1. This offers the advantageous possibility that the rings or radial struts that form the support structure can consist of the same material as the material of the transition layer or the material of the bottom-most ply of the transition layer and preferably can be formed at the same time as the casting, in particular rotational casting of the transition layer, or at the same time as it is foamed. Alternatively the rings or radial struts can consist of the same material as the outer layer and can preferably be introduced during the casting process, in particular rotational casting, or during introduction of the outer layer. All the possible variations mentioned above cause that the rings or radial struts penetrating the compressible layer are formed in one piece with the adjacent layer and at the same time are firmly attached to the inner tube.

In a further alternative configuration the rings can consist also of metal, a thermoplastic or a thermosetting plastic. Advantageously the rings are then implemented in multiple parts, so that they can then also be assembled if the compressible layer is firstly formed and subsequently intermitted by, e.g., turned recesses. The rings or radial struts can also consist of a suitable plastic material, introduced into the recesses or radial holes, such as a cast or filler mass, or similar.

In all configurations the support structure consists of a material, or out of parts or means that are incompressible, or at least more stable in shape, and significantly less compressible than the material of the compressible intermediate layer. In a preferred configuration the rings or radial struts of the support structure are formed at a distance from both end faces of the sleeve. Between two rings or arrangements of radial struts there is preferably maintained a separation distance, which is sufficient for the radial expansion of the inner tube, and does not exceed a distance of, for example, 500 mm.

The radial expansion capability of the inner tube into the compressible layer is limited by the support structure. In order that, nevertheless, the installation of the sleeves is possible using the air cushion principle, suitable measures must therefore be provided in the region of the support structure. In the preferred form of implementation of the sleeves partial depressions are formed on the inner circumference of the inner tube, where preferably the axial length of the depressions is greater than the axial width of the support structure formed, the latter being radially aligned with the depression on the outer surface of the inner tube. Thus, for example, the depressions can consist of circumferential grooves and the support structure includes concentric rings. Here the depth of the depression in the inner tube preferably provides only a very small clearance beyond the outer diameter of the king roll or the adapter sleeve, so that after the installation of the sleeve on the king roll or on the adapter sleeve, because of the expansion of the inner tube the depressions on the inner tube lie essentially in alignment with the other regions of the inner tube on the outer surface of the king roll, without however contributing to its attachment to the king roll, which provides security against rotation. The clearance depth in the region of the depressions should be just sufficient for the installation of these regions without using the air cushion principle, while the other, significantly larger, regions of the inner tube sit on the king roll with a shrink fit.

The outer layer of the sleeves can be formed for the reception of a printing plate or similar, and can consist e.g. of rubber, or can be fitted for the use of tapes with a hard or soft cover layer. The outer layer of the sleeve can also consist of a material such as a photopolymer or silicon polymer, which directly comprises the print motif. Finally the sleeve can also take the form of an adapter or intermediate sleeve on which a printing sleeve can be installed.

Furthermore the sleeve can be configured for the conduction or diverting of electrostatic charging and can comprise an conductive or diverting outer layer or surface coating, which is or can be connected with the contact zone to the king roll on the inner circumference of the inner tube via at least one element beeing electroconductive or electric diverting, such as in particular an element that can alter its length in the radial direction, for the diverting of possible electrostatic chargings. A construction of this type that is able to conduct or transfer charge is described in U.S. Pat. No. 6,745,692, to which reference is hereby made. In a preferred configuration the element that is able to conduct or divert charging is then arranged in the region of the support structure, or is integrated into the means forming the support structure such as rings or radial struts, or is installed inside the latter. For interpretation of the terms conductive or diverting, reference is made to the relevant standards currently in force.

The invention relates also to a preferred method for the manufacture of a sleeve with a multiple layer structure for printing presses with king rolls designed as air cylinders, in which in accordance with the invention recesses or radial holes are formed in the compressible intermediate layer before the applying of the transition or outer layer, which are filled with the material of the transition or outer layer when these are applied, or with an additional material, a ring-shaped or web-shaped support structure being formed in the sleeve, which stabilises the outer layer relative to the inner tube in the circumferential and/or radial direction. The preferred form of implementation of the method is characterised in that during manufacture, in particular during the winding of the inner tube, depressions are formed on the inner circumference of the inner tube, and in that the recesses or radial holes are arranged with the depressions radially aligned in the compressible layer. These measures are sufficient to ensure that, without additional expenditure of effort in the manufacture process for the sleeves, the sleeves contain the support structure and can be installed on the king roll and de-installed from the latter using the air cushion principle.

BRIEF DESCRIPTION OF THE FIGURES

Further advantages and configurations of the sleeve in accordance with the invention arise from the following description of preferred embodiments shown in the figures. In the figures.

DETAILED DESCRIPTION

Figure 1:
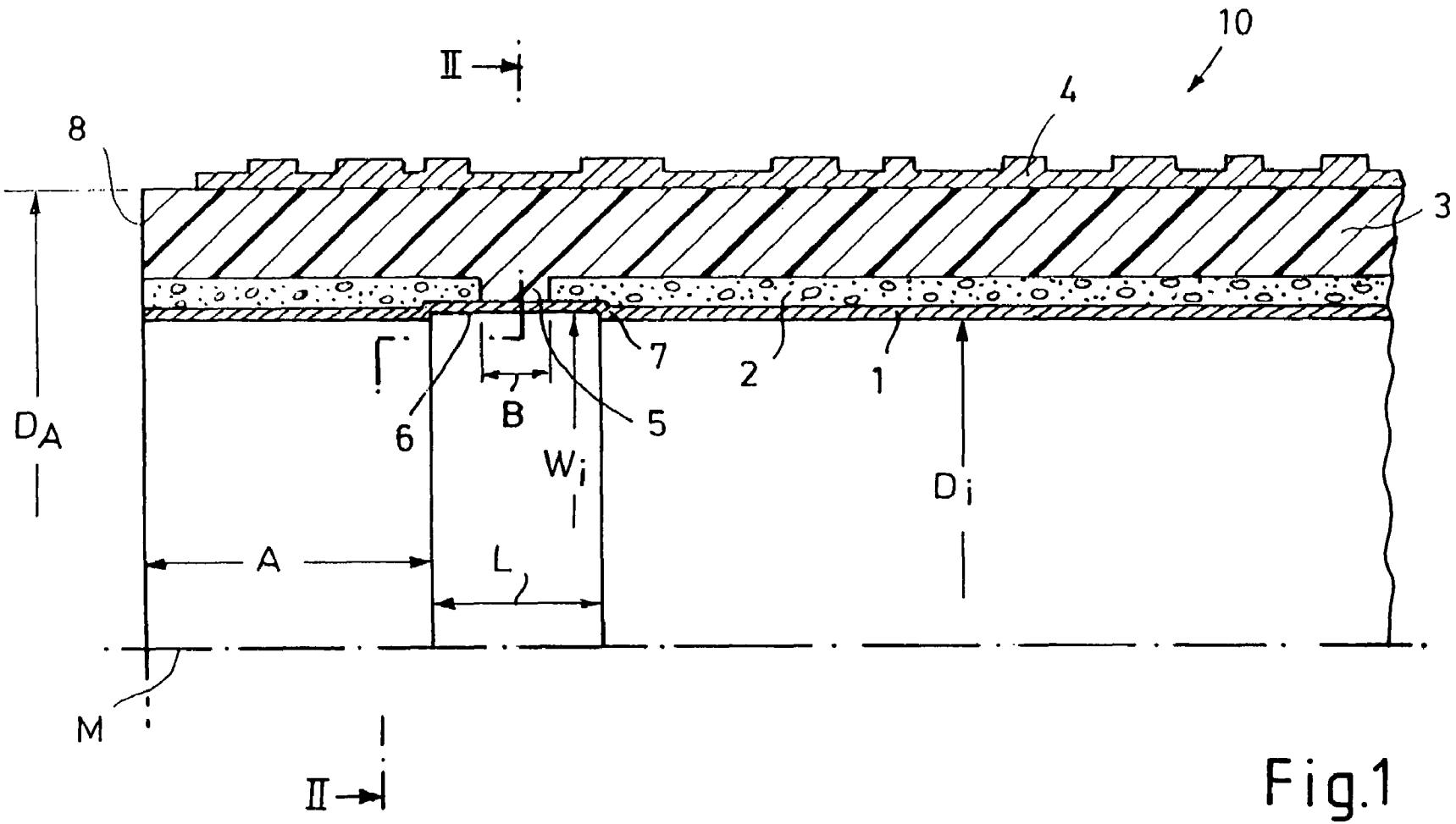
FIG. 1 shows a detail of a longitudinal section view through a sleeve in accordance with a first embodiment of the invention.
Figure 2:
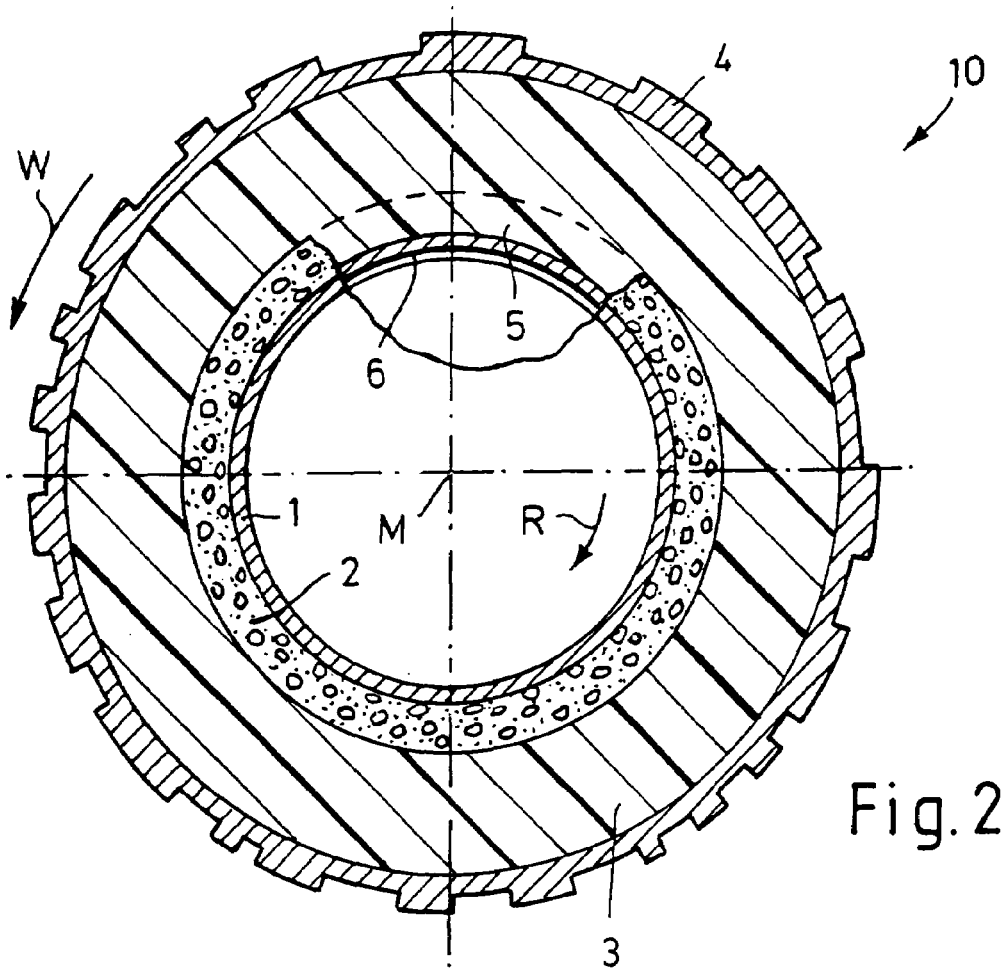
FIG. 2 shows a section view along II-II in FIG. 1.

The sleeve indicated as a whole in FIG. 1 and FIG. 2 by 10 is structured symmetrically with respect to the central axis M and comprises a multiple layer structure with an inner tube 1 of a fibre-reinforced plastic such as a glass fibre reinforced plastic, a carbon fibre reinforced plastic or an aramid fibre reinforced plastic, which by the application of compressed air on the inner circumference can be reversibly expanded. Onto the inner tube 1 is adjoined in the radial direction an intermediate layer 2 of an elastic compressible plastic material such as a suitable soft foam, whose thickness in the radial direction is approximately 1 to 3 mm. The intermediate layer serves to accommodate completely the radial expansion of the inner tube 1 during the mounting or dismounting of the sleeve 10 on a king roll designed as an air cylinder, without alteration of the outer diameter $D_A$ of the sleeve 10 and/or the outer diameters of the layers located over the compressible intermediate layer 2. The compressible layer 2 is surrounded by an outer layer 3 of a plastic material with low density, e.g. a hard foam plastic, by means of which the outer diameter $D_A$ of the sleeve 10 can be varied over a wide range compared with the inner diameter $D_i$ for the field of application, without any significant increase in the total weight of the sleeve 10. For the sleeve 10, a printing plate 4 is installed directly on the outer layer 3, which is configured as a printing platen, or could also consist of a seamless photopolymer layer. The inner diameter $D_i$ of the sleeve 10 is slightly smaller than the outer diameter D of the king roll 20, only represented in FIG. 3, so that after installation, for which the inner tube 1 must be expanded with compressed air, the sleeve 10 sits on the outer surface 21 of the king roll 20 and is secured against rotation. During the printing process the sleeve 10, as indicated in FIG. 2, is driven in the direction of rotation R of the king roll with the rotational speed of the latter. A structure of this type for printing sleeves 10 is known art.

The colour particles necessary for printing are transferred with suitably etched or engraved anilox rolls to the surface of the printing plate 4, and the printing plate 4, circumferentially displaced from the anilox roll, prints on to a substrate, such as a paper web, film or similar (not shown), which is pressed against the sleeve 10 by means of a impression cylinder. Because of the colour particles, the friction between the anilox roll and sleeve 10, and also because of the friction between the substrate onto which printing is to take place and the sleeve 10, a retarding or resistance force is introduced onto the surface of the printing plate 4, which is symbolically represented in FIG. 2 with the arrow W. In the case of the sleeves used up to the present time the resistance force may cause internal displacements in the direction of the resistance force W in the structure of the compressible layer, which are stored by the compressible layer and which, especially if the resistance force W is subjected to greater variations, leads to a momentary, elastic restoration of the compressible layer in the direction of the arrow R. In order to eliminate this problem the sleeves 10 in accordance with the invention are fitted with a support structure, which in the embodiment shown includes a number of rings 5 formed concentrically around the inner tube, which completely penetrate the compressible layer 2 and effect a firm attachment of the outer layer 3 to the inner tube 1. In the emdodiment shown in FIG. 1 and FIG. 2 only one ring 5 is represented, which consists of the same material as the outer layer 3, so that the one or more rings 5 can be formed at the same time as the outer layer 3 is applied. Each ring partially interrupts the compressible elastic intermediate layer 2, bridges the latter partially and thus forms a support structure in the internal construction of the sleeve 10, which stabilises the outer layer 3 and the printing plate 4 relative to the inner tube 1 both in the circumferential direction, i.e. the direction of rotation, and also in the radial direction. In the sleeve 10 in accordance with the invention, due to the support structure, neither an excessive feed pressure between the sleeve 10 and the impression cylinder, nor the resistance force W, can lead to displacements or a walking movement of the compressible intermediate layer 2.

As a result of the partial bridging of the compressible layer 2 by means of the rings 5 formed of incompressible material the inner tube 1 cannot expand radially in the region of the rings 5. In the inner tube 1 therefore depressions 6 are formed, each of which radially aligned with the rings 5, whose inner depth $W_i$ is greater than the outer diameter D (FIG. 3) of the king roll 20 by a small clearance. Each depression 6 has in the axial direction, i.e. parallel to the central axis M of the sleeve 10, a length L and projects on both sides beyond the axial width B of the support rings 5. The ratio L/B is for example approximately 2.5; since it is L>B, the inner tube 1 can also, at the transition locations 7 to the depressions 6, expand into the elastic compressible intermediate layer 2 and can be expanded during sleeve installation or de-installation to an inner diameter that is sufficient for installation to take place.

The depressions 6 and the rings 5 of the support structure are preferably formed at a greater distance A from the end faces 8 of the sleeve 10, in order not to impair the radial expansion of the inner tube 1 at the start of the sleeve installation or de-installation processes.

Figure 3:
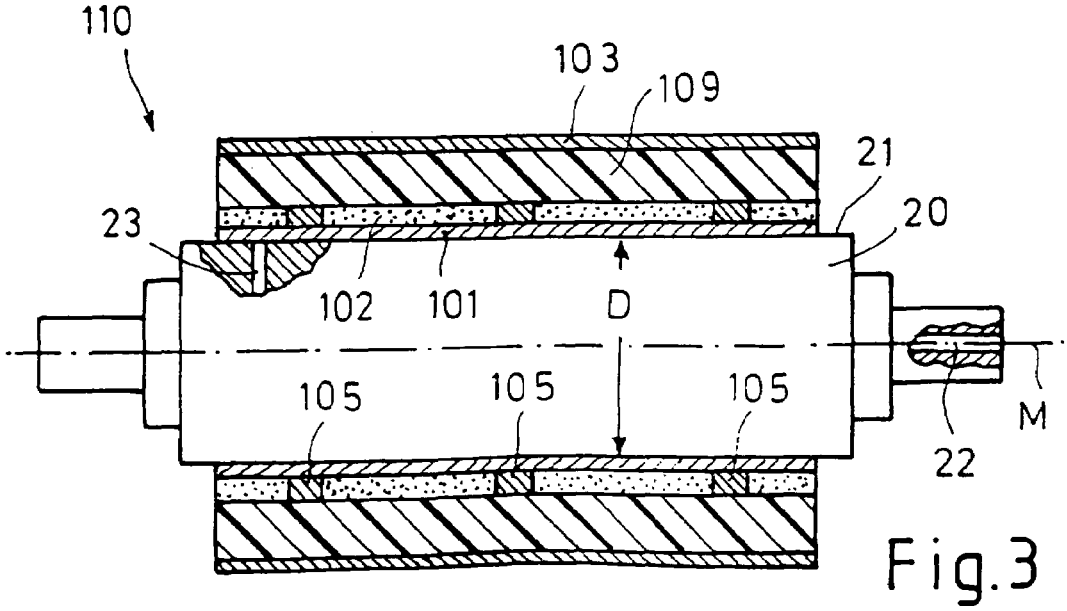
FIG. 3 schematically shows a longitudinal section view through a sleeve installed on a king roll in accordance with a second embodiment.

FIG. 3 shows a second embodiment for a sleeve 110 with multiple layer construction, including an inner tube 101 of fibre reinforced plastic material, a compressible intermediate layer 102, a transition layer 109 of hard foam or similar, and an outer layer 103 of a hard or soft material suitable for the installation of the printing platens or plates that are not shown. The support structure here includes a total of three rings 105, which partially replace the compressible intermediate layer 102 and, for example, consist of two ring halves of metal or plastic, or of a suitable fibrous filler material, or similar.

FIG. 3 shows in addition schematically the king roll 20, designed as an air cylinder, with the central passage 22, preferably formed aligned with the axis M at one end of the king roll 20, for the compressed air connection from the press, and with at least one radial hole 23, via which the compressed air is blown out for generation of the air cushion on the outer surface 21 of the king roll 20. Since this is of known art for the expert, any further representation can be dispensed with.

For the manufacture of the sleeve 110 represented in FIG. 3, after the winding and lamination of the inner tube 101 and the applying of the elastic compressible soft foam forming the intermediate layer 102, a ring-shaped recess is turned out of the intermediate layer 102 as appropriate, which is filled with the material for the support structure rings 105, or into which the ring halves are introduced. The depressions on the inner circumference of the inner tube 106, not represented here, in each case aligned with the support rings 105, can be formed during the manufacture process for the inner tube 101, in which, radially aligned with the position of the support rings 105, to be manufactured later, a thin-walled film is laid on the mandrel for the inner tube 101, that is then wound together with the fibre matrix for the inner tube 101. After the saturation of the fibre matrix with a suitable resin, the hardening of the resin e.g. in a thermal oven, and the release of the inner tube from the mandrel, the depressions are then created by the removal of the films.

In the embodiments, the support structure is shown and described in the form of support rings. Alternatively the support structure could consist of radial struts or similar, which form a type of spoke structure between the inner tube and the outer layer or a number of outer incompressible layers. The transition layer or outer layer can in particular be introduced in the rotational casting procedure, after recesses or radial holes have been formed in the compressible intermediate layer for the support structure. The support structure could also be formed in such a manner that it enables static charges from the surface or outer layer of the sleeve to be transferred to the surface of the king roll, as is described in general in DE 202 04 412 for printing sleeves. The depressions in the inner tube could also be later turned or introduced in another manner. The support structure could also partially replace the inner tube. Such and other modifications are to fall within the area of protection of the attached claims.

The invention claimed is:

1. Sleeve with multiple layer construction for printing presses having a king rolls designed as air cylinders, the sleeve comprising an inner tube of reversibly expandable plastic material, an inner diameter of which is smaller than an outer diameter of the king roll; an elastic, compressible intermediate layer that accommodates radial expansion of the inner tube during mounting or dismounting of the sleeve; an outer layer; and a support structure integrated into the sleeve construction between the inner tube and the outer layer, which completely penetrates the compressible intermediate layer in at least one location in a radial direction and stabilises the outer layer relative to the inner tube in a circumferential direction and/or the radial direction, wherein the support structure comprises radial struts distributed circumferentially in a symmetrical manner, wherein the compressible layer is intermitted by radial holes and the support structure is provided in the radial holes and partially bridges the compressible layer.

2. Sleeve in accordance with claim 1, wherein the radial struts comprise the same material as the outer layer and are formed during casting or introducing of the outer layer.

3. Sleeve in accordance with claim 1, wherein the radial struts comprise a plastic material introduced into the radial holes.

4. Sleeve in accordance with claim 1, wherein the radial struts of the support structure are formed at a distance from both end faces of the sleeve.

5. Sleeve with multiple layer construction for printing presses having a king rolls designed as air cylinders, the sleeve comprising an inner tube of reversibly expandable plastic material, an inner diameter of which is smaller than an outer diameter of the king roll; an elastic, compressible intermediate layer that accommodates radial expansion of the inner tube during mounting or dismounting of the sleeve; an outer layer: and a support structure integrated into the sleeve construction between the inner tube and the outer layer, which completely penetrates the compressible intermediate layer in at least one location in a radial direction and stabilises the outer layer relative to the inner tube in a circumferential direction and/or the radial direction, wherein the support structure includes rings concentrically surrounding the inner tube.

6. Sleeve in accordance with claim 5, wherein the compressible layer is intermitted by concentric, ring-shaped recesses, which are turned recesses, and the support structure is provided in the recesses and partially bridges the compressible layer.

7. Sleeve in accordance with claim 6, wherein the rings comprise a plastic material introduced into the recesses, such as a cast or filler mass, or similar.

8. Sleeve in accordance with claim 5, further comprising a single ply or multiple ply transition layer of a plastic material of low density is provided between the outer layer and the compressible intermediate layer.

9. Sleeve in accordance with claim 8, wherein the transition layer and/or the outer layer comprises a material that can be cast or foamed.

10. Sleeve in accordance with claim 8, wherein the support structure comprises the same material as the material of the transition layer or the material of a bottom-most ply of the transition layer and is formed at the same time as the transition layer is foamed or cast.

11. Sleeve in accordance with claim 5, wherein the outer layer comprises a plastic material of low density.

12. Sleeve in accordance with claim 5, wherein the rings comprise the same material as the outer layer and are formed during casting or introducing of the outer layer.

13. Sleeve in accordance with claim 5, wherein the rings comprise metal, a thermoplastic or a thermosetting plastic and are implemented in a number of parts.

14. Sleeve in accordance with claim 5, wherein the sleeve is an adapter sleeve on which a printing sleeve or similar can be installed.

15. Sleeve in accordance with claim 5, further comprising a conductive or diverting outer layer or surface coating, and an electroconductive or diverting element, which connects an outer layer or surface coating at an inner circumference of the inner tube with an outer wall of the king roll for diverting electrostatic chargings into the king roll.

16. Sleeve in accordance with claim 15, wherein the element comprises a variable length in the radial direction.

17. Sleeve in accordance with claim 15, wherein the element is integrated into the support structure.

18. Sleeve with multiple layer construction for printing presses having a king rolls designed as air cylinders, the sleeve comprising an inner tube of reversibly expandable plastic material, an inner diameter of which is smaller than an outer diameter of the king roll; an elastic, compressible intermediate layer that accommodates radial expansion of the inner tube during mounting or dismounting of the sleeve; an outer layer; and a support structure integrated into the sleeve construction between the inner tube and the outer layer, which completely penetrates the compressible intermediate layer in at least one location in a radial direction and stabilises the outer layer relative to the inner tube in a circumferential direction and/or the radial direction, wherein at least one partial depression is formed on an inner circumference of the inner tube.

19. Sleeve in accordance with claim 18, wherein the axial length of the at least one depression is greater than the axial width of the support structure formed radially aligned with the at least one depression on an outer surface of the inner tube.

20. Sleeve in accordance with claim 18, wherein the at least one depression consists of circumferential grooves and the support structure includes concentric rings.

* * * * *